US008876544B2

(12) United States Patent
Yamaji et al.

(10) Patent No.: US 8,876,544 B2
(45) Date of Patent: Nov. 4, 2014

(54) CONNECTOR HAVING ROTATABLE ACTUATION LEVER WHICH CAN LOCK A CONNECTION BETWEEN A MATING CONNECTOR AND THE CONNECTOR WHEN ACTUATED

(71) Applicant: Japan Aviation Electronics Industry, Limited, Tokyo (JP)

(72) Inventors: Takahiro Yamaji, Tokyo (JP); Takamitsu Nakajima, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 92 days.

(21) Appl. No.: 13/848,977

(22) Filed: Mar. 22, 2013

(65) Prior Publication Data

US 2013/0260601 A1 Oct. 3, 2013

(30) Foreign Application Priority Data

Mar. 27, 2012 (JP) ..... 2012-071450

(51) Int. Cl.

| | |
|---|---|
| ***H01R 13/62*** | (2006.01) |
| ***H01R 13/64*** | (2006.01) |
| ***H01R 13/648*** | (2006.01) |
| ***H01R 13/639*** | (2006.01) |
| ***H01R 12/79*** | (2011.01) |
| *H01R 13/633* | (2006.01) |

(52) U.S. Cl.

CPC ..... *H01R 13/648* (2013.01); *H01R 13/639* (2013.01); *H01R 12/79* (2013.01); *H01R 13/6335* (2013.01)

USPC ..... 439/372

(58) Field of Classification Search

CPC ..... H01R 13/648; H01R 13/639; H01R 13/6335; H01R 13/79

USPC ..... 439/372, 79, 157, 152, 153, 345

See application file for complete search history.

(56) References Cited

U.S. PATENT DOCUMENTS

| | | | | |
|---|---|---|---|---|
| 7,670,150 | B2 * | 3/2010 | Hisamatsu et al. | 439/79 |
| 8,096,823 | B2 | 1/2012 | Tagawa et al. | |
| 2012/0171890 | A1 | 7/2012 | Kurachi | |

FOREIGN PATENT DOCUMENTS

| | | |
|---|---|---|
| JP | 2009-193916 | 8/2009 |
| JP | 2010-067378 | 7/2010 |
| JP | 2012-033431 | 2/2012 |

* cited by examiner

*Primary Examiner* — Javaid Nasri

(74) *Attorney, Agent, or Firm* — Collard & Roe, P.C.

(57) ABSTRACT

A connector can prevent a short circuit between a conductive member positioned on a board and an actuation lever actuatable without an actuation tag. A distance between the board and an actuation portion is larger than another distance between the board and an engage portion under a locked state where the engage portion is engaged with an engaged portion. Under the locked state, the actuation portion is positioned away from the conductive member (a SMT terminal and the conductive pattern formed on the board) so that the actuation lever can be prevented from making the short circuit with the conductive member.

11 Claims, 6 Drawing Sheets

CONNECTOR HAVING ROTATABLE ACTUATION LEVER WHICH CAN LOCK A CONNECTION BETWEEN A MATING CONNECTOR AND THE CONNECTOR WHEN ACTUATED

CROSS REFERENCE TO RELATED APPLICATIONS

Applicants claim priority under 35 U.S.C. §119 of Japanese Patent Application No. JP2012-071450 filed Mar. 27, 2012.

BACKGROUND OF THE INVENTION

The present invention relates to a connector connected with a mating connector mounted on an object such as a board or the like, especially to a connector which has a rotatable actuation lever and which can lock a connection between the mating connector and the connector by rotating the actuation lever.

Connectors of this type are disclosed in, for example, JPA 2009-193916 and JPA 2010-67378, which are incorporated herein by references. Each of the disclosed connectors comprises an actuation lever having an actuation portion. Under a connection state where the connector is connected with the mating connector, the actuation portion of the actuation lever is positioned in the immediate vicinity of a board. Therefore, it is difficult to directly actuate the actuation portion. In order to easily actuate the actuation portion, an actuation tag is attached to the actuation lever.

Under the connection state, the actuation portion of the actuation lever is positioned in the immediate vicinity of SMT terminals of contacts of the mating connector mounted on the board. Therefore, there is a problem that a short circuit may occur between the actuation lever and the SMT terminal or between the actuation lever and a conductive pattern formed on the board. This problem is becoming increasingly serious in a low-profile connector.

The actuation tags are indispensable to the connectors disclosed in JP A 2009-193916 or JP A 2010-67378. However, the actuation tag may be an obstacle depending on the conditions such as a use of the connector or a mounting space.

SUMMARY OF THE INVENTION

It is therefore an object of the present invention to provide a connector which can prevent a short circuit between the actuation lever and a conductive member positioned on an object such as a board, and has an actuation lever actuatable without an actuation tag.

One aspect of the present invention provides a connector configured to be connected with a mating connector which has an engaged portion and is mounted on an object, comprising: a holding portion; and an actuation lever which has an actuation portion, a held portion, an engage portion and a stopper portion and is held by the holding portion so as to rotate when the actuation portion is shifted. The engage portion is provided between the actuation portion and the held portion. The engage portion is engaged with the engaged portion under a connection state, where the connector is connected with the mating connector, so as to lock the connection state. The stopper portion prevents the engage portion from moving to the object under a locked state where the connection state is locked. A distance between the object and the actuation portion is larger than another distance between the object and the engage portion in the locked state.

An appreciation of the objectives of the present invention and a more complete understanding of its structure may be had by studying the following description of the preferred embodiment and by referring to the accompanying drawings.

Figure 1:
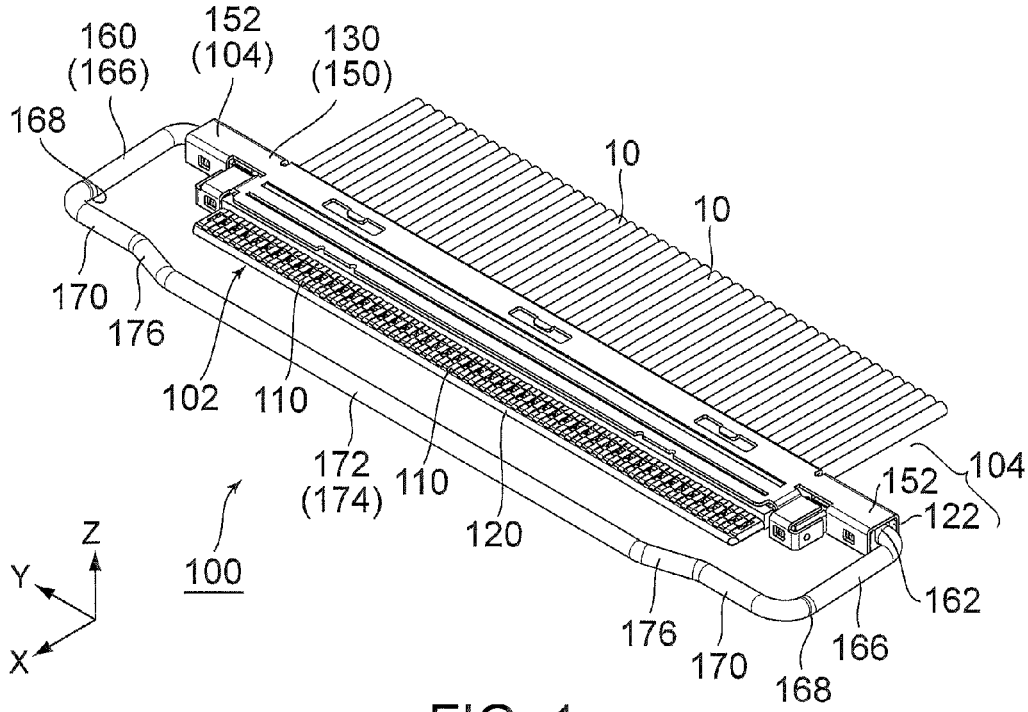
FIG. 1 is a top oblique view showing the connector according to the embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

With reference to FIG. 1 to FIG. 6, a connector assembly of the embodiment according to the present invention comprises a connector 100 and a mating connector 200. The connector 100 of the embodiment is a cable connector connected with a cable 10. The mating connector 200 of the embodiment is a board connector mounted on a board (object) 50. In the following explanation, the connector 100 is inserted into the mating connector 200 in a +X direction (connection direction) and ejected in a −X direction (eject direction). An X direction is a connection-ejection direction and a front-back direction of the connector 100.

Figure 3:
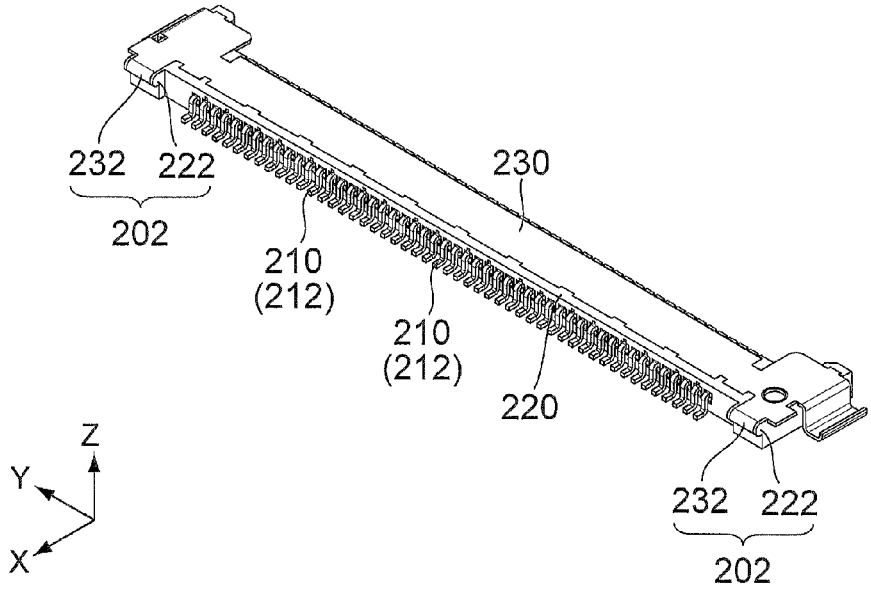
FIG. 3 is an oblique view showing a mating connector according to the embodiment of the present invention.

With reference to FIG. 3, the mating connector 200 comprises a plurality of mating contacts 210, a mating holding member 220 holding the plurality of the mating contacts 210, and a mating shell 230 covering, in part, the mating holding member 220. The mating contacts 210 are press-fitted into the mating holding member 220 from a +X surface and held by the mating holding member 220. As shown in FIG. 3, SMT terminals 212 of the mating contacts 210 project from the +X surface of the mating holding member 220 in the +X direction. The mating shell 230 is inserted into the mating holding member 220 when the mating holding member 220 is formed.

The mating holding member 220 has projection portions 222 formed on the both end portions of the mating holding member 220 in a Y direction (a pitch direction). In other words, the mating holding member 220 of the embodiment has two projection portions 222. Each of the projection portions 222 is formed on upper parts (+Z direction) of the +X surface of the mating holding member 220 and projects in the +X direction. The mating shell 230 has reinforcing portions 232. The reinforcing portions 232 are formed on the both end portions of the mating shell 230. As shown in FIG. 3, the reinforcing portions 232 are embedded in the corresponding projection portions 222 so that parts of the projection portions 222 are exposed at the projection portions 222. In the mating shell 230, the reinforcing portion 232 and the projection portion 222 constitute an engaged portion 202. In other words, the mating connector 200 of the embodiment has two engaged portion 202. The mating contacts 210 are arranged in a line and held between the engaged portions 202 in the Y direction. In detail, all of the SMT terminals 212 are positioned between the engaged portions 202 when seen from above (in a +Z direction) the mating connector 200.

Figure 6:
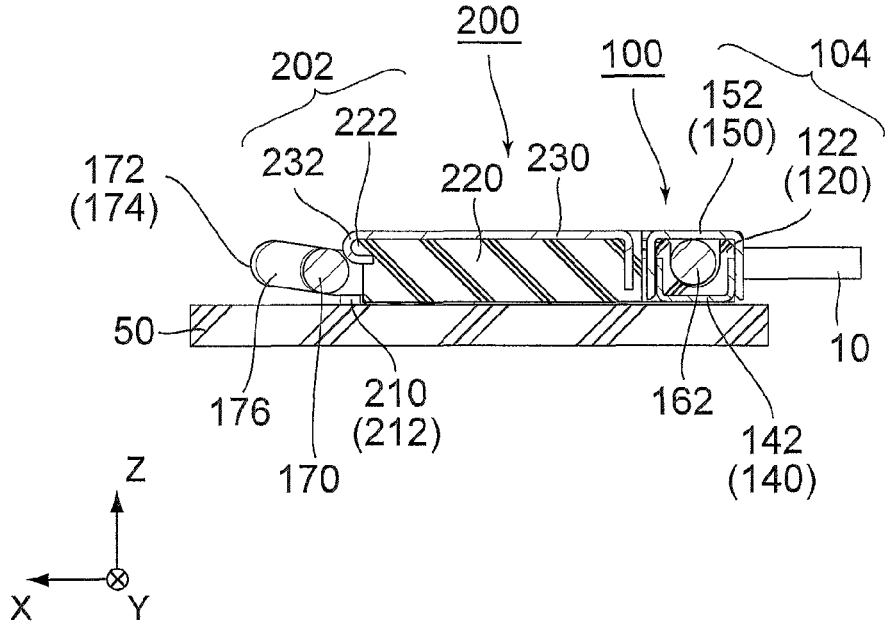
FIG. 6 is a cross-sectional view showing the connector assembly of FIG. 4, taking along line VI-VI.

As clearly shown in FIG. 6, each of the engaged portions 202 has a cross section having a shape of a halved running-track (a horizontally oriented U-shape) and projects in the +X direction. A space is provided under (in a −Z direction) the engaged portions 202.

Figure 2:
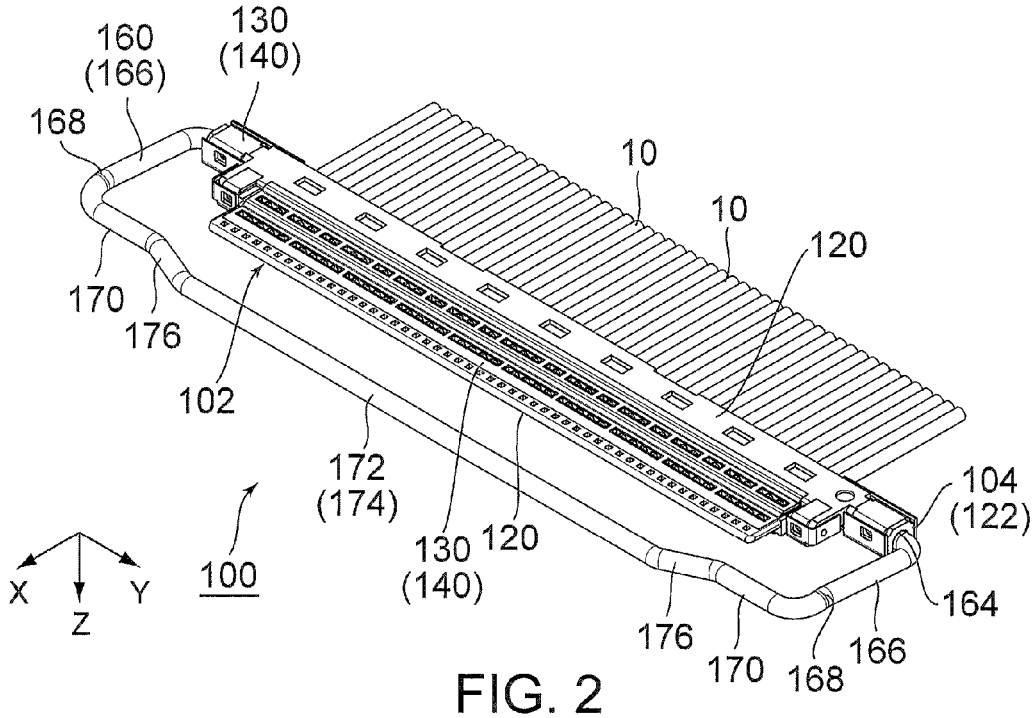
FIG. 2 is a bottom oblique view showing the connector of FIG. 1.

As shown in FIG. 1 and FIG. 2, the connector 100 has a mating portion 102 having a plate-like shape and inserted into the mating connector 200. The connector 100 is connected with the mating connector 200 by inserting the mating portion 102 into the mating connector 200 in the +X direction (see FIG. 4).

In detail, the connector 100 comprises a plurality of conductive contacts 110, a holding member 120 made of insulative material and holding the plurality of the contacts 110, a shell 130 made of metal and covering, in part, the holding member 120, and an actuation lever 160 made of metal.

The contacts 110 of the embodiment are inserted into the holding member 120 when the holding member 120 is formed by an insert-mold process.

The holding member 120 of the embodiment has two receiving portions 122. The receiving portions 122 are formed in the vicinity of the both end sides of the holding member 120 in the Y direction. As best shown in FIG. 6, each of the receiving portions 122 has a cross section having a U-like shape (a half pipe-like shape) in a ZX surface perpendicular to the Y direction. In detail, the cross section of the receiving portion 122 has a semicircular section and two straight-line sections extending upward from both ends of the semicircular section. In other words, the receiving portion 122 has a curved-bottom surface corresponding to the semicircular section and flat surfaces corresponding to the straight-line sections. Each of the receiving portions 122 serves as a part of holding portion 104 which holds one of the end portions (held portions 162, 164, explained hereafter) of the actuation lever 160 so as to allow the actuation lever 160 to rotate.

Figure 4:
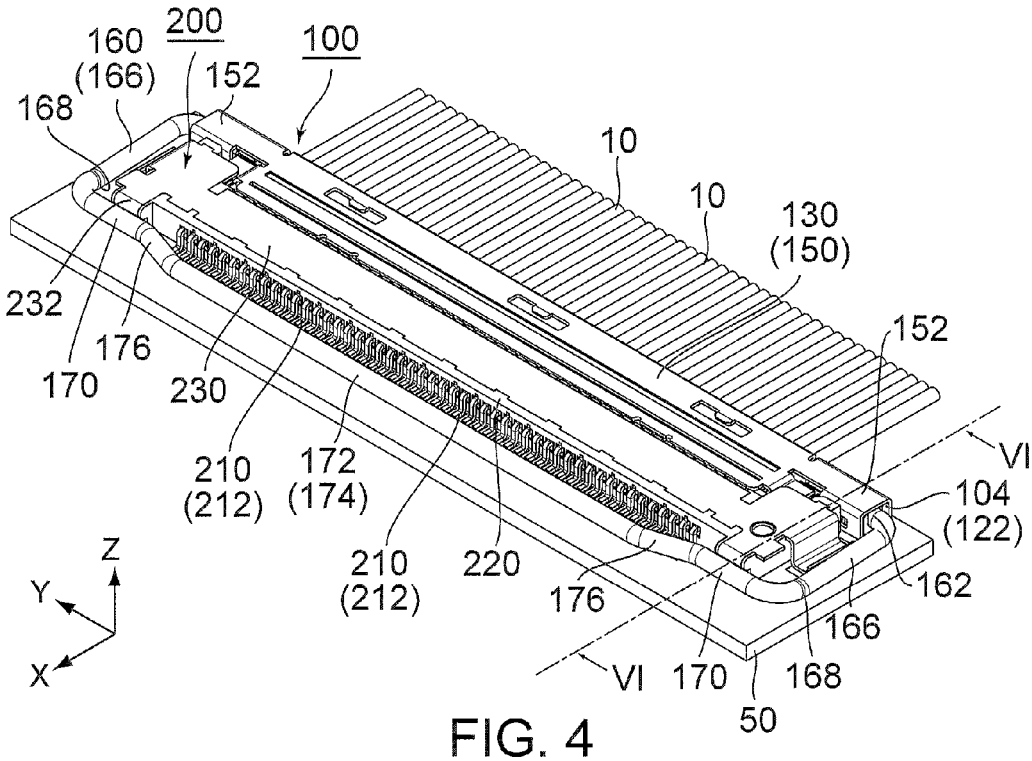
FIG. 4 is an oblique view showing a connector assembly constituted by the connector of FIG. 1 and the mating connector of FIG. 3.

The shell 130 of the embodiment has a first shell 140 and a second shell 150. The first shell 140 is inserted into the holding member 120 when the holding member 120 is formed by an insert-mold process. As shown in FIG. 6, a part of the first shell 140 constitutes a bottom portion 142. The bottom portion 142 is arranged under the holding member 120 and reinforces the receiving portion 122. On the other hand, the second shell 150 is attached to the holding member 120 after the cable 10 is connected with the connector 100. As shown in FIG. 4, the second shell 150 has two lid portions 152. The lid portions 152 are formed on both ends of the second shell 150. As shown in FIG. 6, the lid portion 152 covers the receiving portion 122. The lid portion 152 and the receiving portion 122 constitute the above-described holding portions 104.

Figure 7:
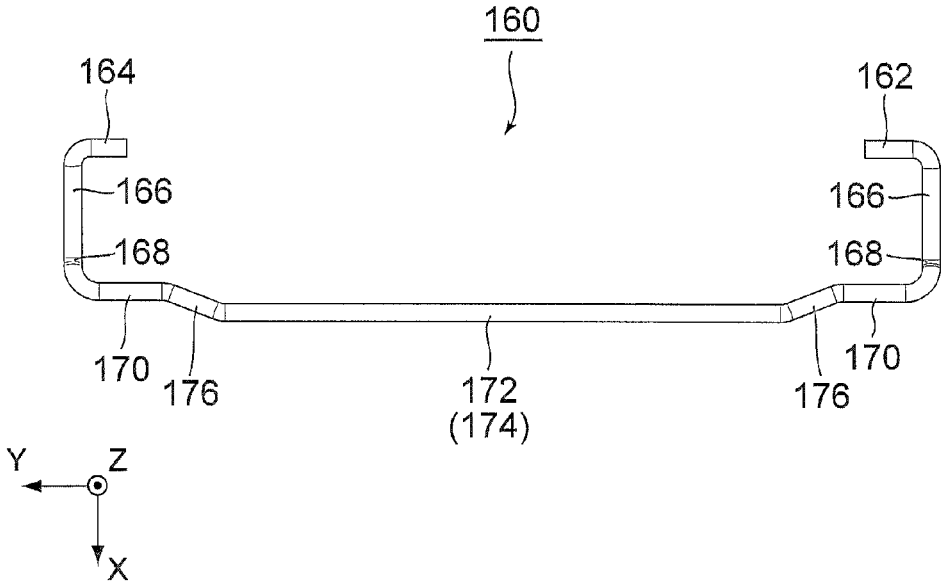
FIG. 7 is a top view showing an actuation lever of the connector of FIG. 1.

As shown in FIG. 1, FIG. 2 and FIG. 7, the actuation lever 160 of the embodiment is formed by bending a rod having a circular cross section (i.e. a round rod). The actuation lever 160 has two held portions 162, 164, two arms 166, two engage portions 170 and an actuation portion 172. The held portions 162, 164 are formed on both ends of the actuation lever 160. The arms 166 extend from the held portions 162, 164, respectively. The engage portions 170 extend from the arms 166. The actuation portion 172 is provided between the engage portions 170. In other words, each of the engage portions 170 is provided between the corresponding arm 166 and the corresponding actuation portion 172.

Figure 5:
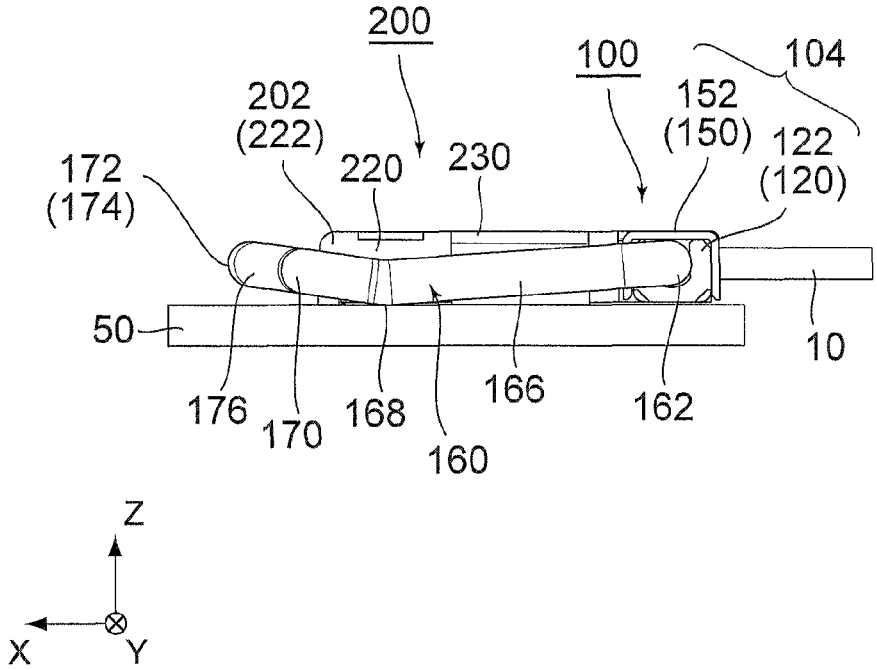
FIG. 5 is side view showing the connector assembly of FIG. 4.

As best shown in FIG. 7, the held portion 162 extends from the arm 166 in the +Y direction while the held portion 164 extends from the arm 166 in the −Y direction, and the held portion 162 and the held portion 164 are arranged in line. In other words, the held portion 162 and the held portion 164 extend closer to one another in the Y direction. As shown in FIG. 5, the actuation lever 160 of the embodiment has an asymmetric shape (a V shape) in the Z direction. To prevent the actuation lever 160 from being attached upside down, as shown in FIG. 7, the held portion 162 is longer than the held portion 164. In other words, the length of the held portion 162 and the length of the held portion 164 are different from each other. With this structure, the actuation lever 160 is attached to the connector 100 correctly (see FIG. 5). As understood from FIG. 1 and FIG. 2, the held portion 162 and the held portion 164 are held by the holding portion 104 of the connector 100 so as to be rotatable.

As best shown in FIG. 7, each of the arms 166 extends in a direction cross to the Y direction. Especially, the arms 166 of the embodiment extend in a direction perpendicular to the Y direction. As described above, the arm 166 has a bent portion bent in the V shape when seen along the Y direction. As understood from FIG. 1 and FIG. 5, a vertex of the bent portion is positioned lower than end portions of the V shape under a state where the actuation lever 160 is attached to the connector 100. In other words, the shape of the bent portion is not an inverted V shape.

With reference to FIG. 7, each of the engage portions 170 extends inward from the corresponding end portion of the arm 166 in the Y direction. In other words, the engage portions 170 of the embodiment are in parallel with the held portions 162 and the held portion 164. In the present embodiment, the engage portions 170, the held portions 162 and the held portion 164 are in parallel with the Y direction. As shown in FIG. 4 to FIG. 6, the engage portion 170 is positioned below the engaged portion 202 of the mating connector 200 under a connection state where the connector 100 is connected with the mating connector 200. In other words, the engage portion 170 is positioned obliquely downward of the engaged portion 202 in the connection state. The engage portion 170 and the engaged portion 202 are engaged with each other so as to maintain the connection state. Even if the engage portion 170 unexpectedly moves upward, the engage portion 170 would be engaged with the engaged portion 202 so that the connector 100 is prevented from ejecting from the mating connector 200. Therefore, the connection state is maintained even if the connector 100 receives undesired force in −X direction.

As understood from FIG. 5 and FIG. 6, a distance between the board 50 and the actuation portion 172 is larger than another distance between the board 50 and the engage portion 170 under a locked state where the engage portion 170 is engaged with the engaged portion 202. "The locked state" includes not only the state where the engage portion 170 is engaged with the engaged portion 202 but also a state where the engage portion 170 can be engaged with the engaged portion 202. Therefore, a user can easily actuate and shift the actuation portion 172 so that the locked state is released. Especially, in the embodiment, as shown in FIG. 5 and FIG. 6, the actuation portion 172 is positioned away from the SMT terminal 212 in the Z direction (in an up-down direction) under the locked state so that the actuation lever 160 is not brought into contact with the SMT terminal 212. In addition, the actuation portion 172 is positioned also away from a conductive pattern (not shown) formed on the board 50 in the Z direction in the locked state so that the actuation lever 160 is not brought into contact with the conductive pattern (not shown).

With reference to FIG. 7, the actuation portion 172 is positioned between the engage portions 170. The actuation portion 172 is bent in a direction away from the held portions 162, 164 (in the +X direction). As best shown in FIG. 4, the actuation portion 172 is bent in a direction away from the SMT terminal 212 (in the +Z direction) under the locked state. Therefore, the actuation portion 172 of the embodiment is positioned away from the SMT terminal 212 in the X direction, and the Z direction so that the actuation lever 160 is prevented from being brought into contact with the SMT terminal 212.

In detail, the actuation portion 172 has a main portion 174 and connection portions 176 positioned on the both ends of the main portion 174. The main portion 174 extends in the Y direction. In other words, the main portion 174 of the embodiment extends in parallel with the held portions 162, 164. The main portion 174 of the embodiment extends also in parallel with the engage portion 170. The connection portions 176 connect between the main portion 174 and the engage portions 170 so that the engage portions 170 are positioned between the held portions 162, 164 and the main portion 174. In other words, as shown in FIG. 5, a distance between the held portion 162 (164) and the main portion 174 is larger than another distance between the held portion 162 (164) and the engage portion 170. Therefore, as shown in FIG. 7, the engage portion 170 and the main portion 174 differ in position in the X direction. With this structure, the main portion 174 can be positioned away from the SMT terminals 212.

As understood from FIG. 5 and FIG. 6, under the locked state, the vertex of the bent portion of the arm 166 is positioned on the board 50 or in the vicinity of the board 50 so that when the engage portion 170 is moved to the board 50 the vertex of the bent portion is brought into contact with the board 50, and the engage portion 170 is prevented from moving to the board 50. In other words, the vertex of the bent portion of the arm 166 serves as the stopper portion 168 which prevents the engage portion 170 from moving to the board 50 under locked state.

As understood from FIG. 5 and FIG. 6, under the locked state, a distance between the stopper portion 168 and the board 50 is smaller than another distance between the engage portion 170 and the board 50. In other words, the stopper portion 168 is positioned lower, i.e. in the proximity of the board 50, than the engage portion 170 in the Z direction. Therefore, the stopper portions 168 are brought into contact with the board 50 before the engage portions 170 are brought into contact with the board 50 so that the stopper portions 168 can prevent the engage portions 170 from moving downward. The stopper portion 168 of the embodiment is brought into contact with the board 50 under the locked state (see FIG. 5). However, the stopper portion 168 may be apart from the board 50 under the locked state. According to the embodiment, under the locked state, the actuation lever 160 is not brought into contact with either the SMT terminals 212 nor the conductive pattern (not shown) of the board 50, i.e. the actuation lever 160 is away from either the SMT terminals 212 or the conductive pattern, so that the actuation lever 160 does not make a short circuit with either the SMT terminal 212 nor the board 50.

In the embodiment, the stopper portion 168 is provided on the arm 166. However, the stopper portion 168 may be provided on any other portion. For example, a protruding portion may be formed under the projection portion 222 of the mating holding member 220, and the protruding portion may be used as the stopper portion 168. However, in order to position the actuation portion 172 away from the board 50, it is preferred that the arm 166 is bent in the V-shape, and the vertex portion is used as the stopper portion 168.

Figure 8:
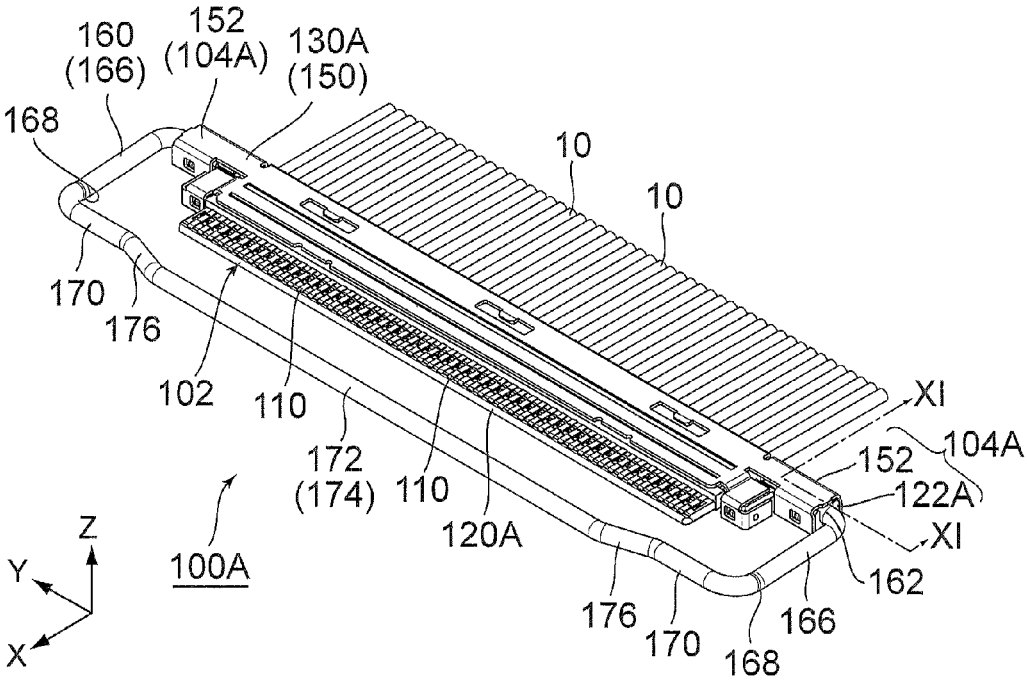
FIG. 8 is a top oblique view showing a variation example of the connector.
Figure 9:
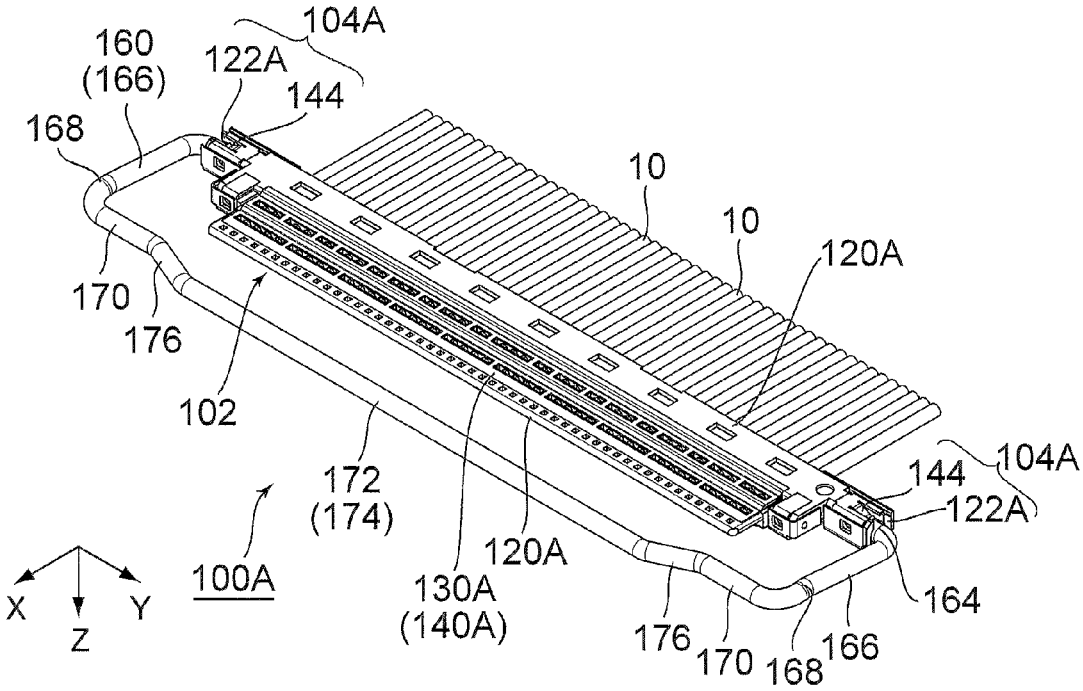
FIG. 9 is a bottom oblique view showing the connector of FIG. 8.
Figure 10:
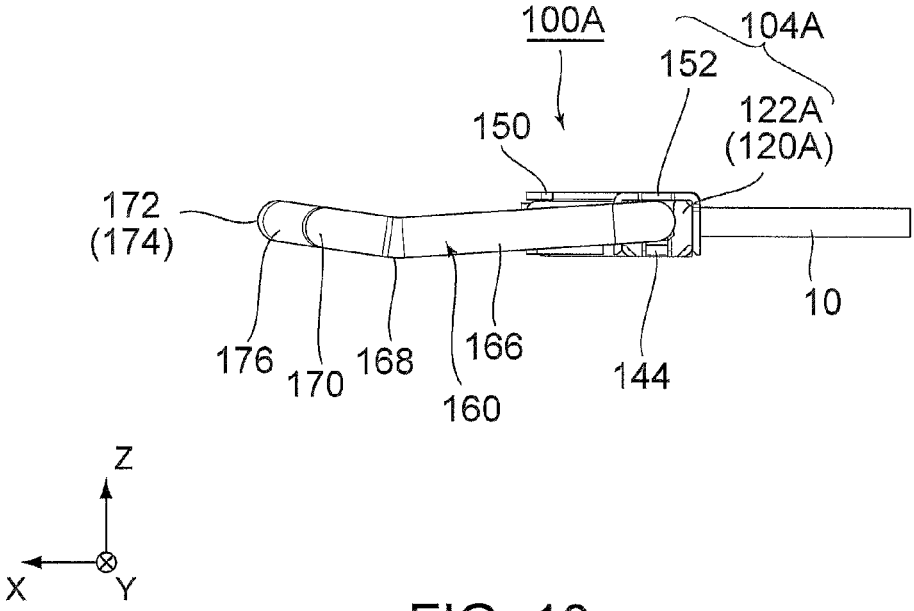
FIG. 10 is a side view showing the connector of FIG. 8.

With reference to FIG. 8 to FIG. 10, the connector 100A is a variation example of the above-described connector 100 (see FIG. 1 to FIG. 7). The connector 100A has the same structure as the connector 100 except for the holding portion 104A. Therefore, the explanation will be made about the holding portion 104A mainly.

The illustrated connector 100A comprises two receiving portions 122A formed on a holding member 120A, two spring portions 144 formed on a first shell 140A and two lid portions 152 formed on the second shell 150.

In detail, each of the receiving portions 122A has two wall portions. One of the wall portions is apart from the other one of wall portions by a distance corresponding to a diameter of the held portion 162 (164). Each of the spring portions 144 has a fixed end and a free end and positioned between two wall portions. The fixed end of the spring portion 144 is fixed to the first shell 140A. As shown in FIG. 9, the spring portion 144 extend obliquely, i.e. outward and upward, from the first shell 140A in the Y direction so that the spring portion 144 can be elastically deformed in the Z direction. Each of the lid portions 152 is positioned over the two walls and covers two walls and the held portion 162 (164).

Figure 11:
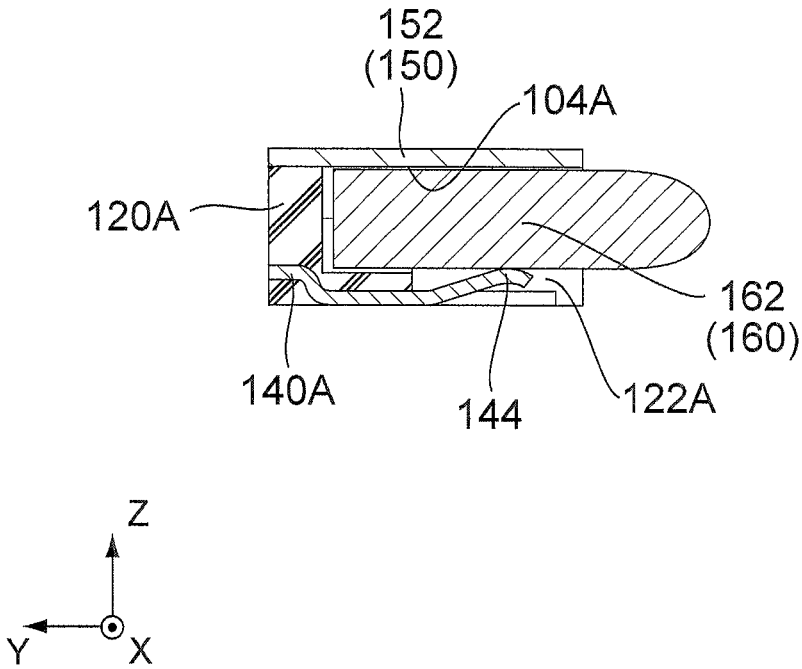
FIG. 11 is a cross sectional view showing a part of the connector of FIG. 8, taking along line XI-XI.

In this variation example, with reference to FIG. 11, when the held portions 162, 164 are not held by the holding portions 104A, a distance between the lid portion 152 and the upper end of the spring portion 144 is slightly smaller than the diameter of the held portion 162 (164). Therefore, as shown in FIG. 11, the spring portion (push portion) 144 pushes the held portion 162 (164) upward when the held portion 162 (164) is inserted into and held by the holding portion 104A. As understood from FIG. 4, FIG. 8 and FIG. 11, the held portions 162 (164) is pushed upward, i.e. in a direction away from the board 50, by the spring portions 144 under the connection state. With this structure, the engage portion 170 is pressed against the engaged portion 202. With reference to FIG. 10, when the stopper portion 168 is brought into contact with the board 50 (not shown), the spring portion 144 push the held portions 162 (164) upward so that the engage portions 170 receive the downward force. Therefore, the engage portion 170 is prevented from being disengaged from the engaged portion 202 so that the locked state is maintained.

In above-described embodiment, the connectors 100, 100A are cable-connectors while the mating connector 200 is a board-connector. However, the present invention is not limited thereto. Each of the connectors 100, 100A may be connected with any object except for the cable 10 while the mating connector 200 may be any mounted another object except for the board 50.

The present application is based on a Japanese patent application of JP2012-071450 filed before the Japan Patent Office on Mar. 27, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector configured to be connected with a mating connector which has an engaged portion and is mounted on an object, comprising:

a holding portion; and an actuation lever which has an actuation portion, a held portion, an engage portion and a stopper portion and is held by the holding portion so as to rotate when the actuation portion is shifted, the engage portion being provided between the actuation portion and the held portion, the engage portion being engaged with the engaged portion under a connection state, where the connector is connected with the mating connector, so as to lock the connection state, the stopper portion preventing the engage portion from moving to the object under a locked state where the connection state is locked, a distance between the object and the actuation portion being larger than another distance between the object and the engage portion in the locked state.

2. The connector according to claim 1, wherein a distance between the object and the stopper portion is smaller than another distance between the object and the engage portion under the locked state.

3. The connector according to claim 1, wherein the connector is connected with the mating connector in a connection direction, the held portion extending in a pitch direction perpendicular to the connection direction, the actuation lever comprising an arm extending from the held portion in a direction cross to the pitch direction, the stopper portion being formed on the arm.

4. The connector according to claim 3, wherein the arm has a bent portion bent in a V-shape, a vertex of the bent portion serving as the stopper portion which abuts with the object when the engage portion is moved to the object so as to prevent the engage portion from moving to the object.

5. The connector according to claim 3, wherein the engage portion is provided between the arm and the actuation portion.

6. The connector according to claim 3, wherein the engage portion extends in the pitch direction.

7. The connector according to claim 1, wherein the stopper portion is always brought into contact with the object in the locked state.

8. The connector according to claim 1, further comprising:

a plurality of contacts;

a holding member which holds the plurality of the contacts and has a receiving portion having a U-like shape, the receiving portion serving as a part of the holding portion; and a shell covering, at least in part, the holding portion.

9. The connector according to claim 1, wherein the actuation lever has two of the engage portions, the actuation portion being positioned between the engage portions and being bent in a direction away from the held portions.

10. The connector according to claim 1, wherein the actuation lever is formed by bending a rod-like member and has two of the held portions, the lengths of the held portions being different from each other.

11. The connector according to claim 1, further comprising a push portion which pushes the held portion in a direction away from the object in the connection state.

* * * * *